US008992352B1

(12) United States Patent
Lindsay et al.

(10) Patent No.: US 8,992,352 B1
(45) Date of Patent: Mar. 31, 2015

(54) VARIABLE LAUNCH CONTROL BAT

(71) Applicant: Vyatek Sports, Inc., Fountain Hills, AZ (US)

(72) Inventors: Howard Alvin Lindsay, Scottsdale, AZ (US); Richard S. Meitz, III, Phoenix, AZ (US)

(73) Assignee: Vyatek Sports, Inc., Fountain Hills (AU)

( * ) Notice: Subject to any disclaimer, the term of this patent is extended or adjusted under 35 U.S.C. 154(b) by 0 days.

(21) Appl. No.: 13/741,100

(22) Filed: Jan. 14, 2013

Related U.S. Application Data

(60) Provisional application No. 61/631,858, filed on Jan. 13, 2012.

(51) Int. Cl.
*A63B 59/06* (2006.01)
*A63B 59/00* (2006.01)

(52) U.S. Cl.
CPC ..... *A63B 59/06* (2013.01); *A63B 59/0074* (2013.01)
USPC ..... 473/566; 473/567; 473/519

(58) Field of Classification Search
USPC ..... 473/457, 519, 520, 564–568
See application file for complete search history.

(56) References Cited

U.S. PATENT DOCUMENTS

| | | | | |
|---|---|---|---|---|
| 1,499,128 | A * | 6/1924 | Shroyer, Jr. | 473/519 |
| 3,116,926 | A * | 1/1964 | Owen et al. | 473/457 |
| 3,963,239 | A * | 6/1976 | Fujii | 473/519 |
| 4,056,267 | A * | 11/1977 | Krieger | 473/520 |
| 6,146,291 | A * | 11/2000 | Nydigger | 473/566 |
| 6,508,731 | B1 * | 1/2003 | Feeney et al. | 473/567 |
| 7,201,679 | B2 * | 4/2007 | Nguyen | 473/520 |
| 7,381,141 | B2 * | 6/2008 | Van Nguyen | 473/566 |
| 7,419,446 | B2 * | 9/2008 | Nguyen | 473/567 |
| 8,435,143 | B2 * | 5/2013 | Vander Pol et al. | 473/566 |
| 2002/0072439 | A1 * | 6/2002 | Feeney | 473/566 |
| 2007/0202973 | A1 * | 8/2007 | Van Nguyen | 473/564 |

* cited by examiner

*Primary Examiner* — Mark Graham
(74) *Attorney, Agent, or Firm* — Law Offices of Damon L. Boyd, PLLC

(57) ABSTRACT

A ball bat comprising a cast metal barrel region with uniform thickness adjoining a carbon handle and a carbon end cap.

5 Claims, 13 Drawing Sheets

MOI/Mass Breakdown

Batted Ball Physics 101:

Mass Comparison

| | Shell | Mass | % To BESR | MOI | % to BESR |
|---|---|---|---|---|---|
| A | BESR | 380.8 | - | 5729.1 | - |
| B | BBCOR | 429.7 | 12.8% | 6477.6 | 13.1% |
| C | BBCOR ISOGRID | 290.0 | -23.8% | 4364.5 | -23.8% |
| D | BBCOR ISOGRID W/O MASS | 283.1 | -25.7% | 4258.2 | -25.7% |
| E | BBCOR ISOGRID W 179G MASS | 462.1 | 21.3% | 6940.8 | 21.1% |

| | Expendable Mass | Shell | End Knob | Carbon Handle/Endcap | Total | Disposable Mass |
|---|---|---|---|---|---|---|
| A | BESR | 380.8 | 22.0 | 331 | 733.8 | 117.2 |
| B | BBCOR | 429.7 | 22.0 | 331 | 782.7 | 68.3 |
| C | BBCOR ISOGRID | 290.0 | 22.0 | 331 | 643.0 | 208.0 |
| D | BBCOR ISOGRID W/O MASS | 283.1 | 22.0 | 331 | 636.1 | 214.9 |
| E | BBCOR ISOGRID W 179G MASS | 462.1 | 22.0 | 331 | 815.1 | 35.9 |

Shell A - .112" Thick @ Sweet spot

Shell B - .157" Thick @ Sweet spot

Shell C

Shell D

MOI/Mass Breakdown

Technology Curve for Barrel Weight vs. Barrel Stiffness

Enhanced tube Specific-Stiffness like an I-Beam

Key Formula:

$I_c = \pi/64(OD^4 - ID^4)$

| | |
|---|---|
| $A_t = 0.283\ in^2$ | $A_{IG} = 0.178\ in^2$ (-37%) |
| $I_c = 0.029\ in^4$ | $I_{cIG} = 0.020\ in^4$ (-31%) |
| $I_p = 0.058\ in^4$ | $I_{pIG} = 0.040\ in^4$ (-31%) |
| $I_c/A_t = 0.10\ in^2$ | $I_{cIG}/A_{IG} = 0.11\ in^2$ (+10%) |
| $I_p/A_t = 0.20\ in^2$ | $I_{pIG}/A_{IG} = 0.22\ in^2$ (+10%) |

VARIABLE LAUNCH CONTROL BAT

CROSS-REFERENCE TO RELATED APPLICATIONS

This application is a non-provisional application of and claims priority to U.S. provisional application Ser. No. 61/631,858, filed Jan. 13, 2012, and entitled "NOVEL DESIGN AND PROCESS FOR HIGH-PERFORMANCE BAT DESIGNS, FEATURING VARIABLE LAUNCH CONTROL," which is incorporated herein by reference in its entirety.

FIELD OF INVENTION

This invention relates to a new high-performance ball bat.

BACKGROUND OF THE INVENTION

The current bat designs are generally made either of metal, composites or some combination of the two. The bats are monolithic (single material) in the barrel region or are multiwall designs made up of multiple materials.

Current bat designs are designed to maximize rebound velocity and there are varying methods designers use to achieve the same. Recent changes have been implemented by the various governing bodies for bats (such as the NCAA) limiting rebound velocity (or performance) under the guise of safety. For college players, this new BBCOR (Batted-Ball-Coefficient-Of Restitution) requirement went into effect Jan. 1, 2011. The requirement for most high school players goes into effect Jan. 1, 2012. This new BBCOR standard replaced a BESR (Ball-Exit-Speed-Ratio) requirement that had been in place for many years.

The history of metal bats is significant and can be traced to the early 1970's when the aluminum bat was first developed and commercialized. The NCAA approved aluminum bats in 1974 and aluminum has been the dominant metal bat material for decades.

Aluminum has been so integral to bat development that aluminum engineers at Alcoa and Kaiser credit baseball bats with much of the driving force behind high strength alloy development. A summary of the basis for this relates to the physics of the bat-ball collision and although not detailed herein, the accepted "norm" is that if you make the bat impact region "thinner" the rebound velocity will increase. A graph of various materials is attached to this application as FIGS. 1 and 2.

As described herein, the new "performance limiting" standards (BBCOR and ABI-Accelerated-Break-In) relate to the present invention and related features and benefits. Aluminum bats have improved steadily over the years as a direct result of advances in alloys. Stronger alloys allow bat designers to "thin-out" the impact zone (without the bat denting) and have resulted in higher and higher performance. These higher strength alloys are generally more expensive so there was a direct correlation between high strength alloy bats, high cost and high performance results (i.e., more rebound velocity). However, as noted earlier, the new BBCOR requirement has severely hampered 40 years of "conventional innovation" (better alloys or creative and complex multi-wall construction) all aimed at more rebound (i.e., "hotter" bat) velocity.

Composite bats also are a part of the high performance bat market. The materials and lay-up designs can be manipulated to produce barrel sections that are "softer." A peculiar aspect of composite bats is that as they "wear out," or the various layers begin to delaminate for separate), the barrel region actually gets even softer, and thus the rebound velocity at impact actually improves. There is a point of diminishing returns, but players have been known to strategically "break-in" their composite bats to secure added initial performance. This practice lead to the NCAA to ban composite bats a few years back and now they have implemented an "ABI" procedure as part of the qualification process to try and eliminate composite designs that "change" (i.e., get softer through delamination) over time. This has hampered the advantage composite bats have/had over aluminum. Composite bats (and their materials) are more expensive than aluminum.

These composite bats also must meet the new BBCOR requirement which means that designers must use "more" of this expensive composite material to ensure the right stiffness for "BBCOR" and enough strength for "ABI." This adds little value and appears to be a carry-over from the marketing benefit of composites.

Thus, in summary, current bats must use expensive aluminum alloys, available only in "wrought" raw material conditions, in attempts to obtain performance standards that used to be "strength and weight" driven. This high strength to weight ratio is called "specific strength" and whether it was aluminum, titanium or composites, this was the "preferred" choice and selection. The performance standard was also either rebound velocity or maybe a derivative called "finding a larger sweet spot" which also dealt with velocity.

Future "high-performance" bats need to find a new parameter besides rebound velocity (for safety) and are preferably made of less costly materials and processes, and further and deliver features and benefits not solely focused on materials and/or construction.

SUMMARY OF THE INVENTION

An embodiment of the present invention is a ball bat comprising a cast metal barrel adjoining a carbon handle and a carbon end cap.

BRIEF DESCRIPTION OF THE DRAWINGS

The accompanying drawings.

DETAILED DESCRIPTION

Figure 1:
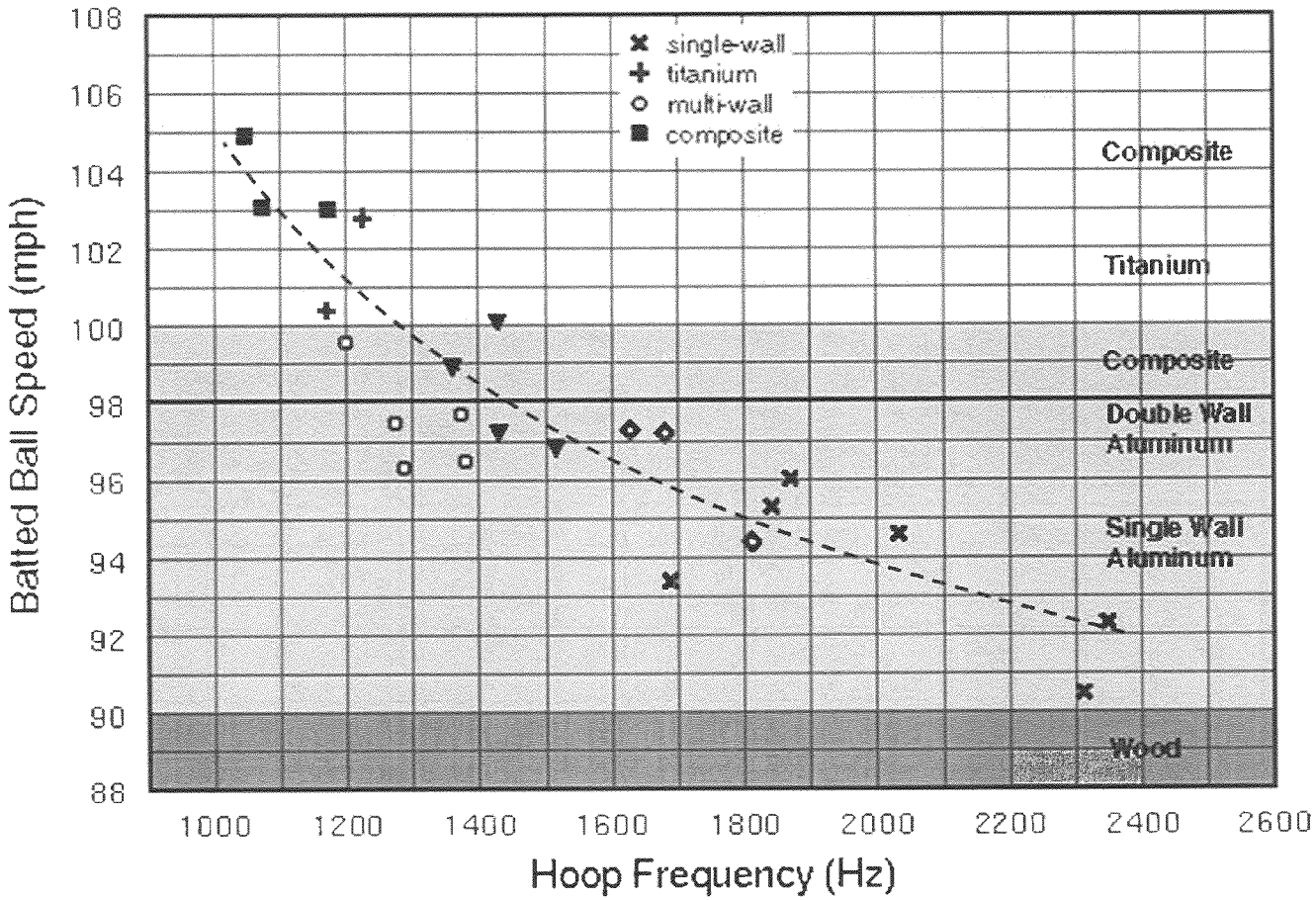
FIG. 1-13 are included to illustrate embodiments of the disclosure.
Figure 2:
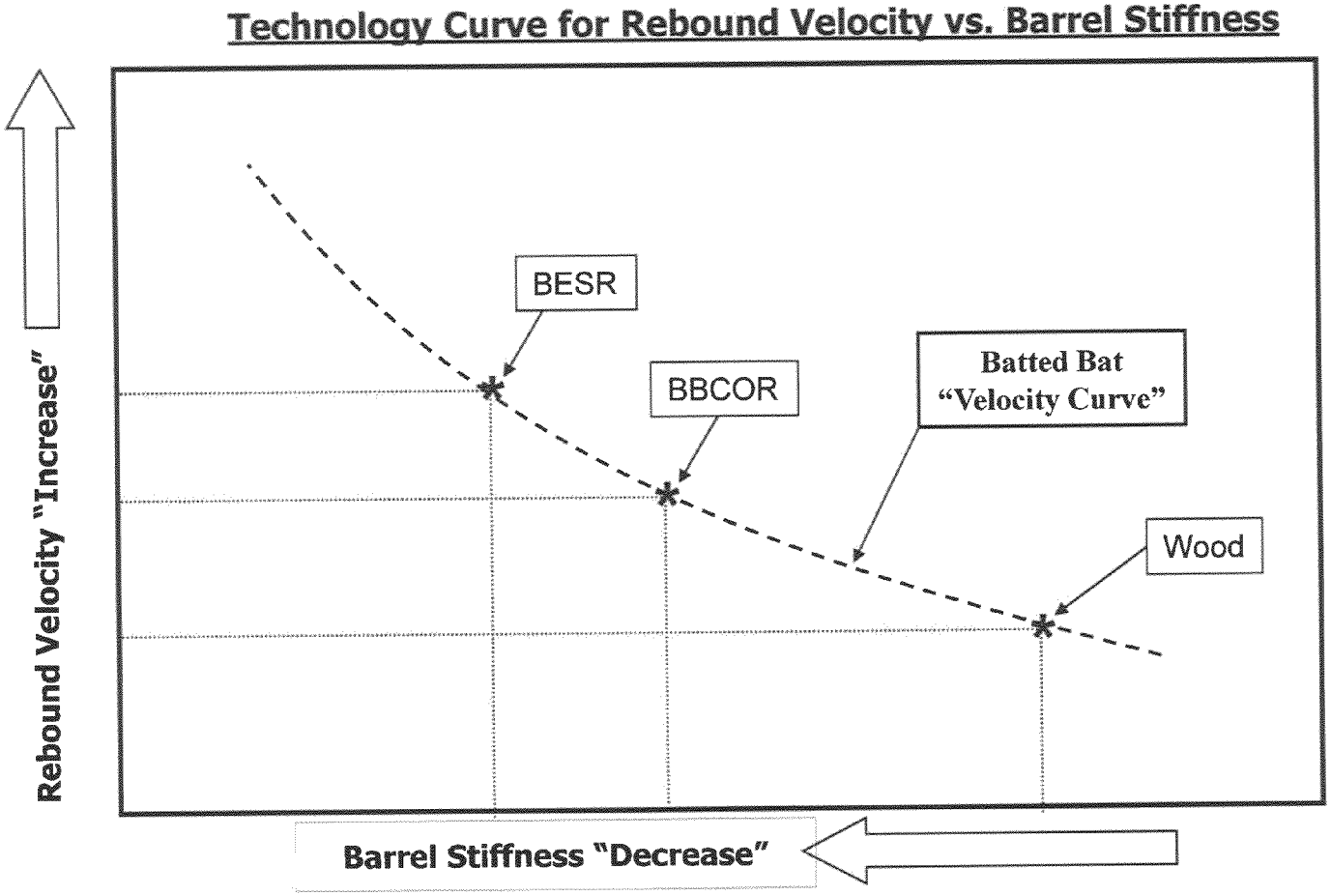

Persons skilled in the art will readily appreciate that various aspects of the present disclosure can be realized by any number of methods and systems configured to perform the intended functions. Stated differently, other methods and systems can be incorporated herein to perform the intended functions. It should also be noted that the accompanying drawing figures referred to herein are not all drawn to scale, but may be exaggerated to illustrate various aspects of the present disclosure, and in that regard, the drawing figures should not be construed as limiting. Finally, although the present disclosure can be described in connection with various principles and beliefs, the present disclosure should not be bound by theory.

The present invention is a new design and construction that also uses "non-conventional" metallic materials. An embodiment uses low-cost casting technologies to produce the barrel region of the bat. This process can create conventional "standard uniform wall thickness" profiles like existing "wrought" aluminum bats but at much lower costs. It can also produce complex, feature enhanced designs like the product shown as FIG. 3. This section features an Isogrid® by Vyatek Sports, Inc., raised-rib structure on the inner diameter of the barrel to add stiffness at a reduced weight.

This ability to "cast" the barrel section opens up a multitude of enhancement features and different materials, that could not be made with conventional wrought, drawing, swaging, butting operations with metals.

Although "as-cast" properties are not typically as strong as wrought properties, the new BBCOR requirement allows that the wall-thickness be increased, allowing lower specific strength materials to "meet the requirement" for baseball and softball (and others) bats.

Figure 3:
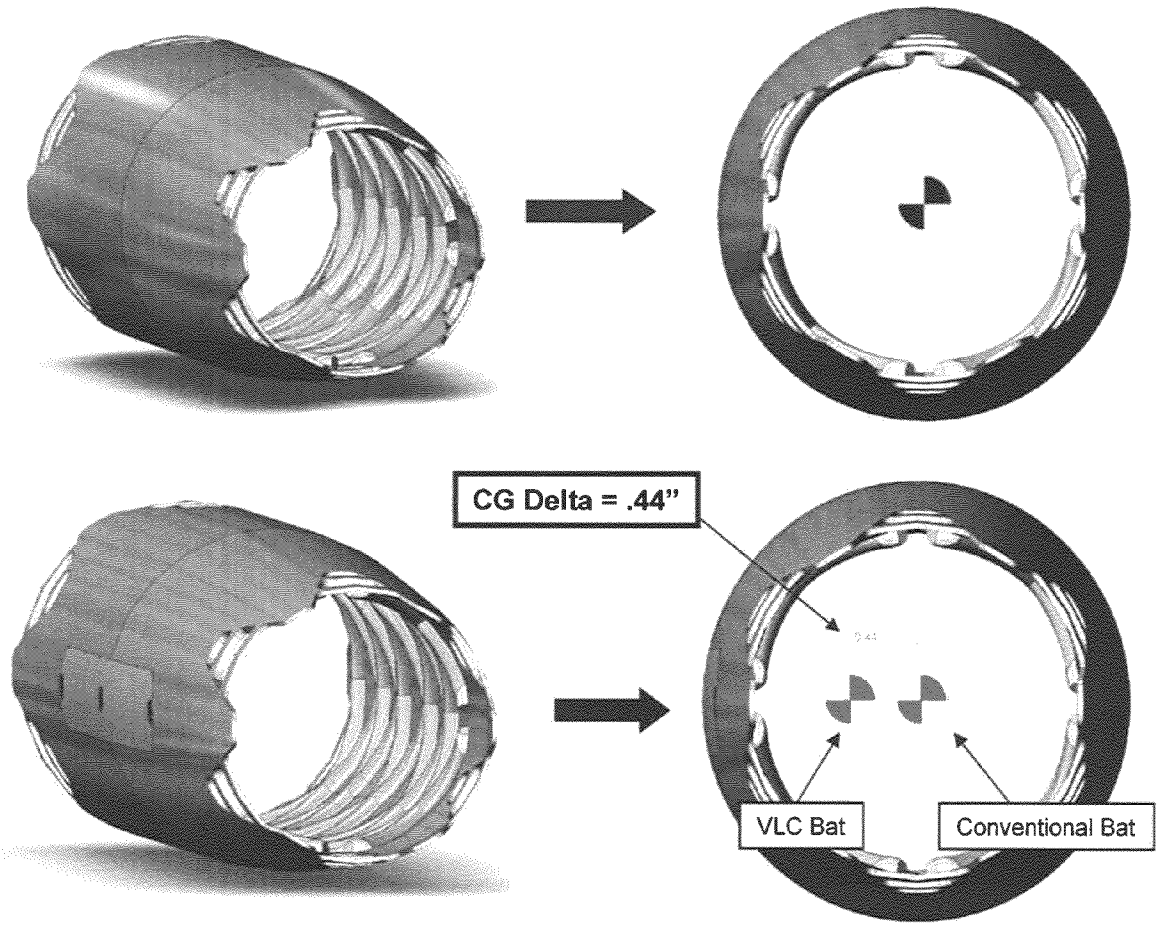
Figure 4:
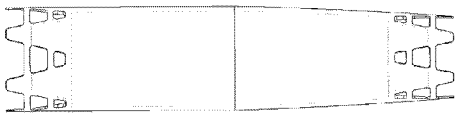
Figure 4:
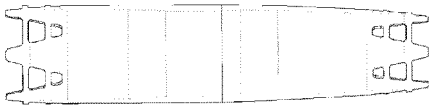
Figure 4:
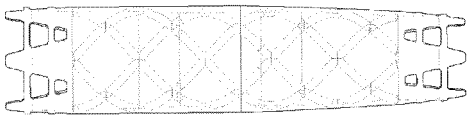
Figure 4:
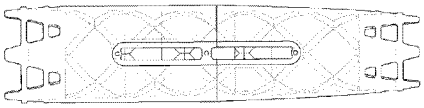

In an embodiment, the present invention also provides removable/adjustable weight insert that creates an asymmetric center of gravity (CG) position in the barrel impact region. Players can now rotate and position the bat to achieve a specific goal "direction" (up or down) depending upon the circumstances of the situation. FIG. 3 shows how this asymmetric system (called VLC™ in these graphics) allows the CG to move 0.44.

Figure 5:
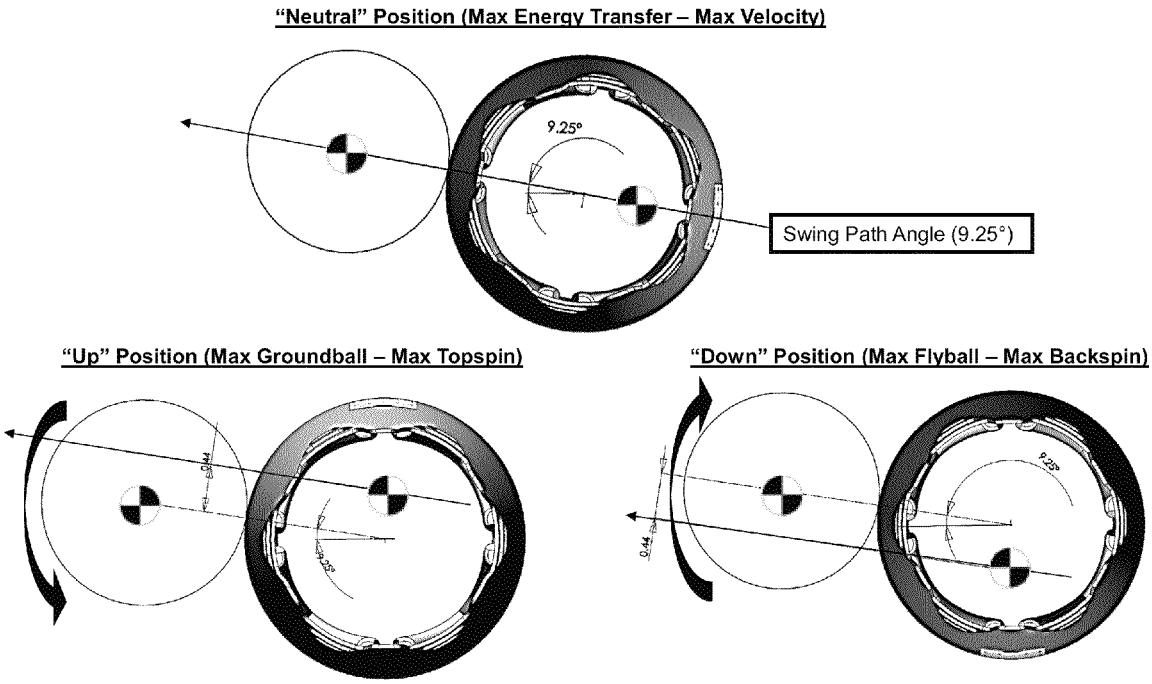
Figure 7:
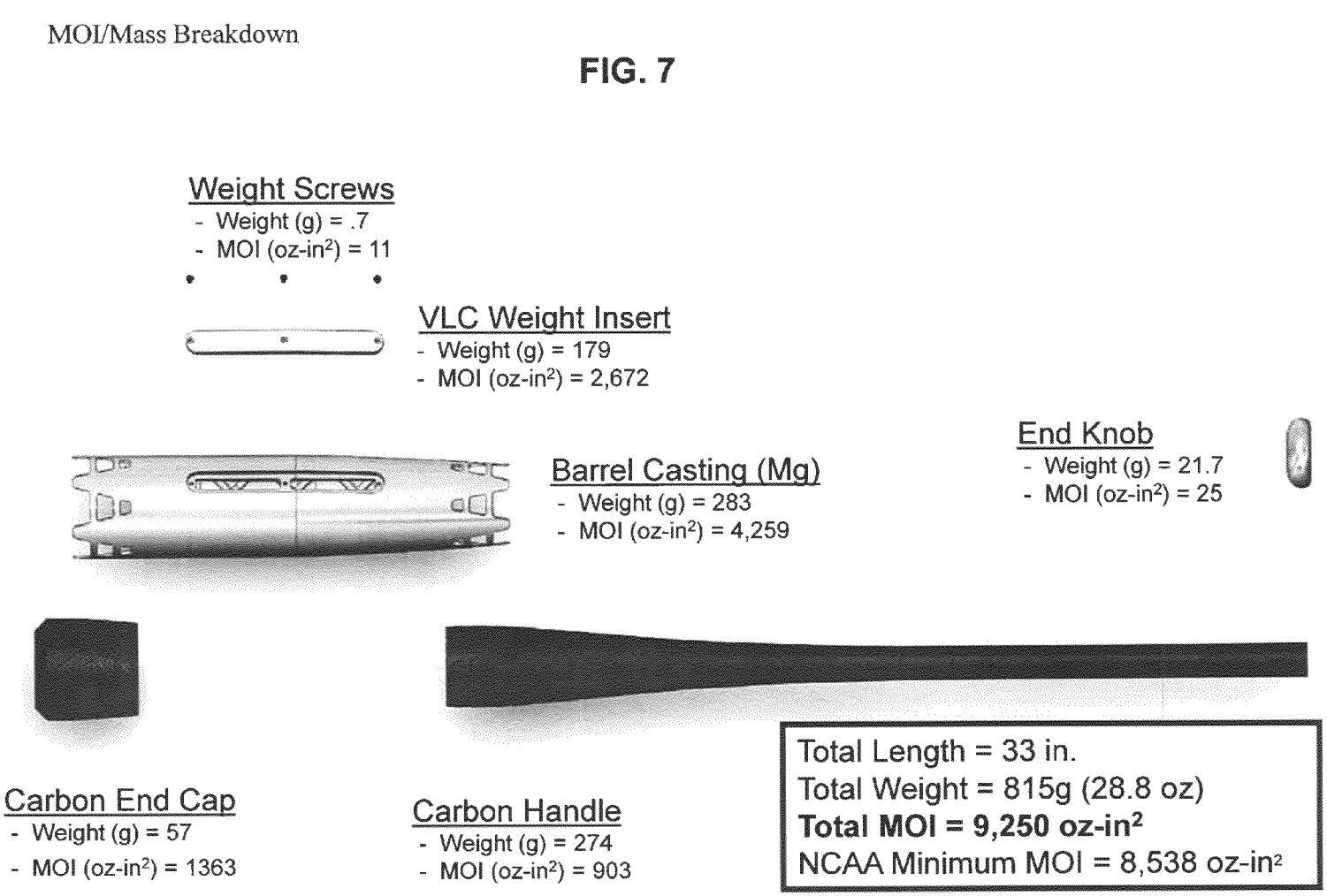
Figure 8:
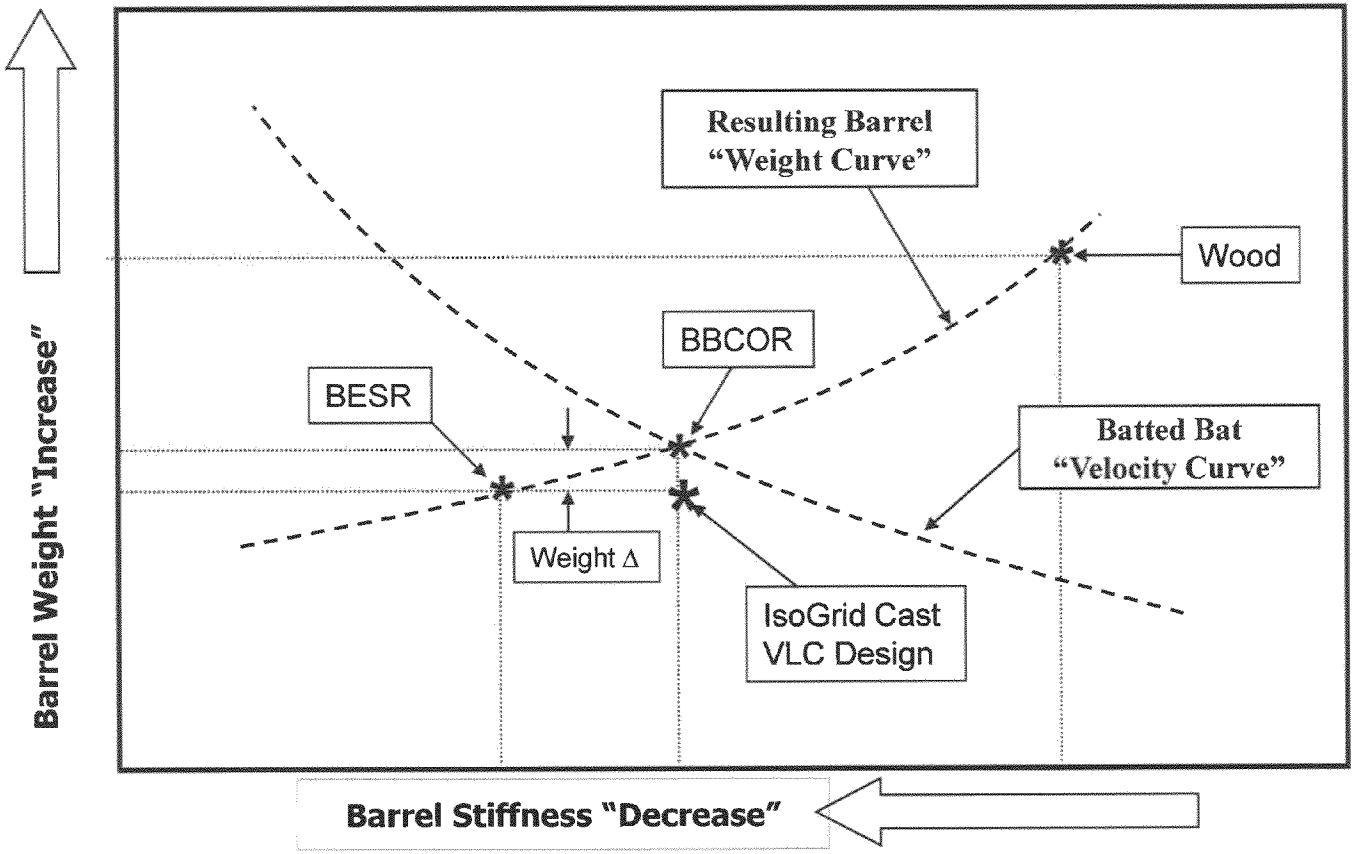
Figure 9:
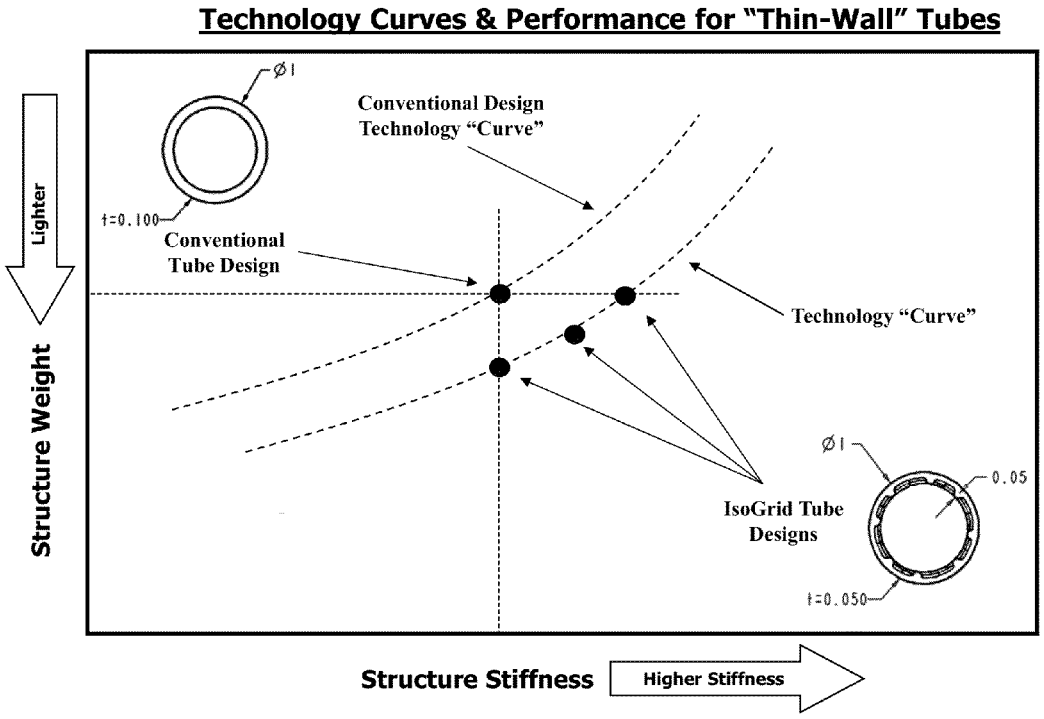
Figure 10:
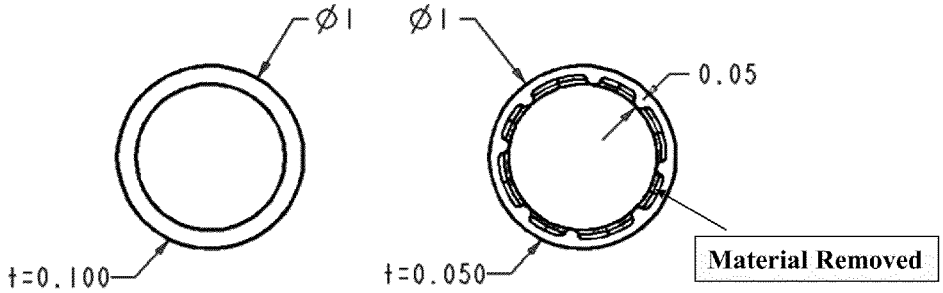
Figure 11:
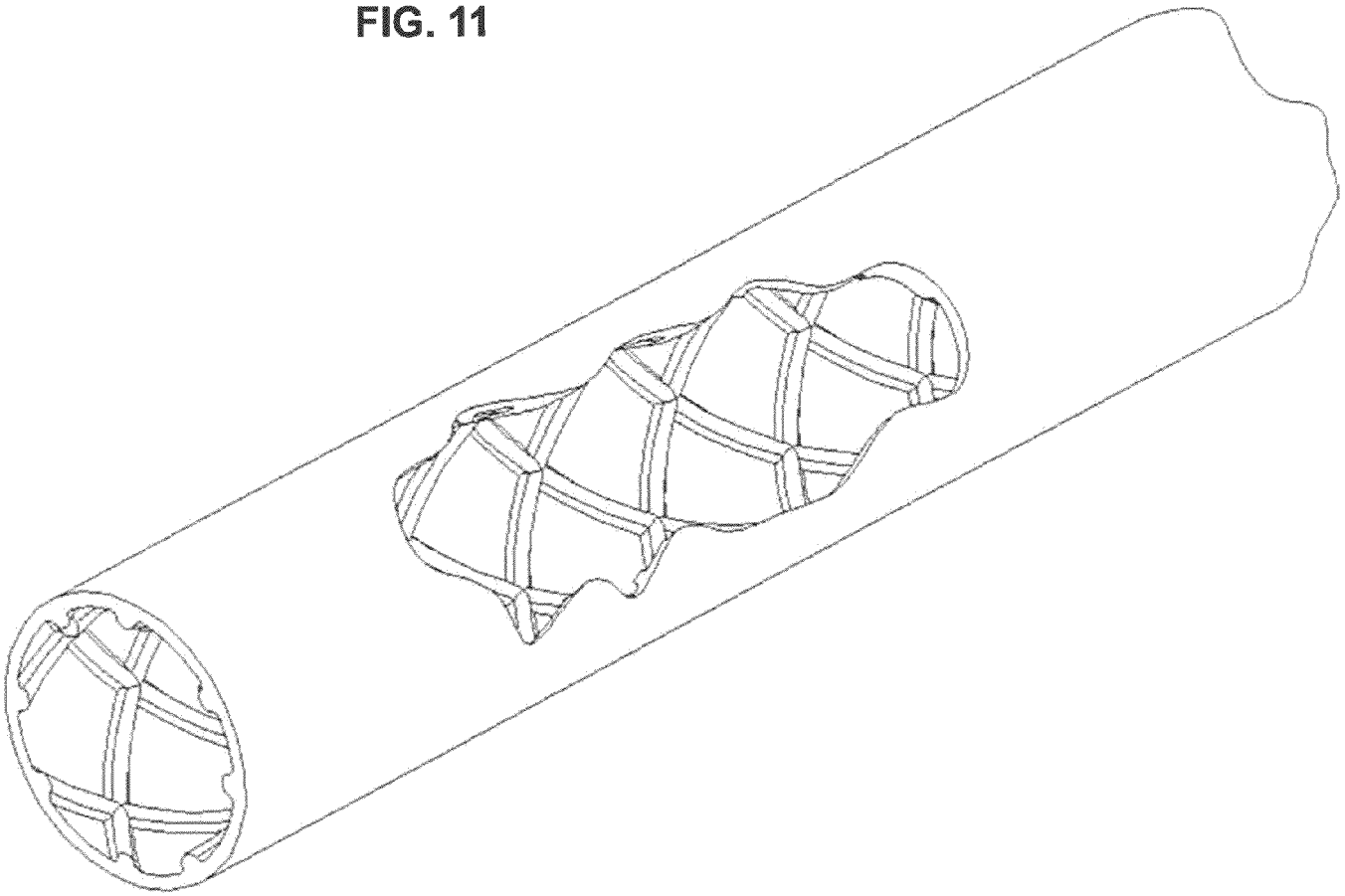

This is made possible (in part) by the Isogrid® cast section, which allows there to be extra weight to reposition strategically, FIG. 7 shows how 179g can be redirected to help deliver this new benefit of variable launch control. FIG. 5 shows cross-sections of three possible impact positions and the resulting change in CG alignment that these scenarios produce. This new feature (VLC™) allows the design of bats with adjustable moment-of-inertia (MOI) profiles, balance point (BP) and spin characteristics (due to CG manipulation).

This VLC™ feature can be executed in "cast metals" as well as molded into composite based sections as well. In general, any method of varying CG position by rotating the position of the bat is within the scope of the present invention, and thus increases the likelihood of a desired impact position (see FIG. 5) at the moment of impact.

The loss of thin-wall bat capabilities has created a corresponding loss in home run (power) capabilities and the need to produce runs (offense) via what is commonly referred to as "small ball." These conditions are typically focused on singles, walks, hits, runs and bunts, and a batter's ability to increase the odds of hitting a ground ball when desired (e.g., a hit and run situation) or a fly ball when desired (e.g., a sacrifice fly to score or move a runner).

Metal-Matrix-Composites (MMC's) are a class of materials that have never been applied to bats. Their high specific-stiffness levels would be ideally suited to these new BBCOR bats as the "stiffness" of these materials are generally better than their "strength." With the thicker barrel sections, these materials such as aluminum oxide ($Al_2O_3$) or silicon carbide reinforced aluminum, could yield more discretionary weight for the VLC™ system.

Figure 6:
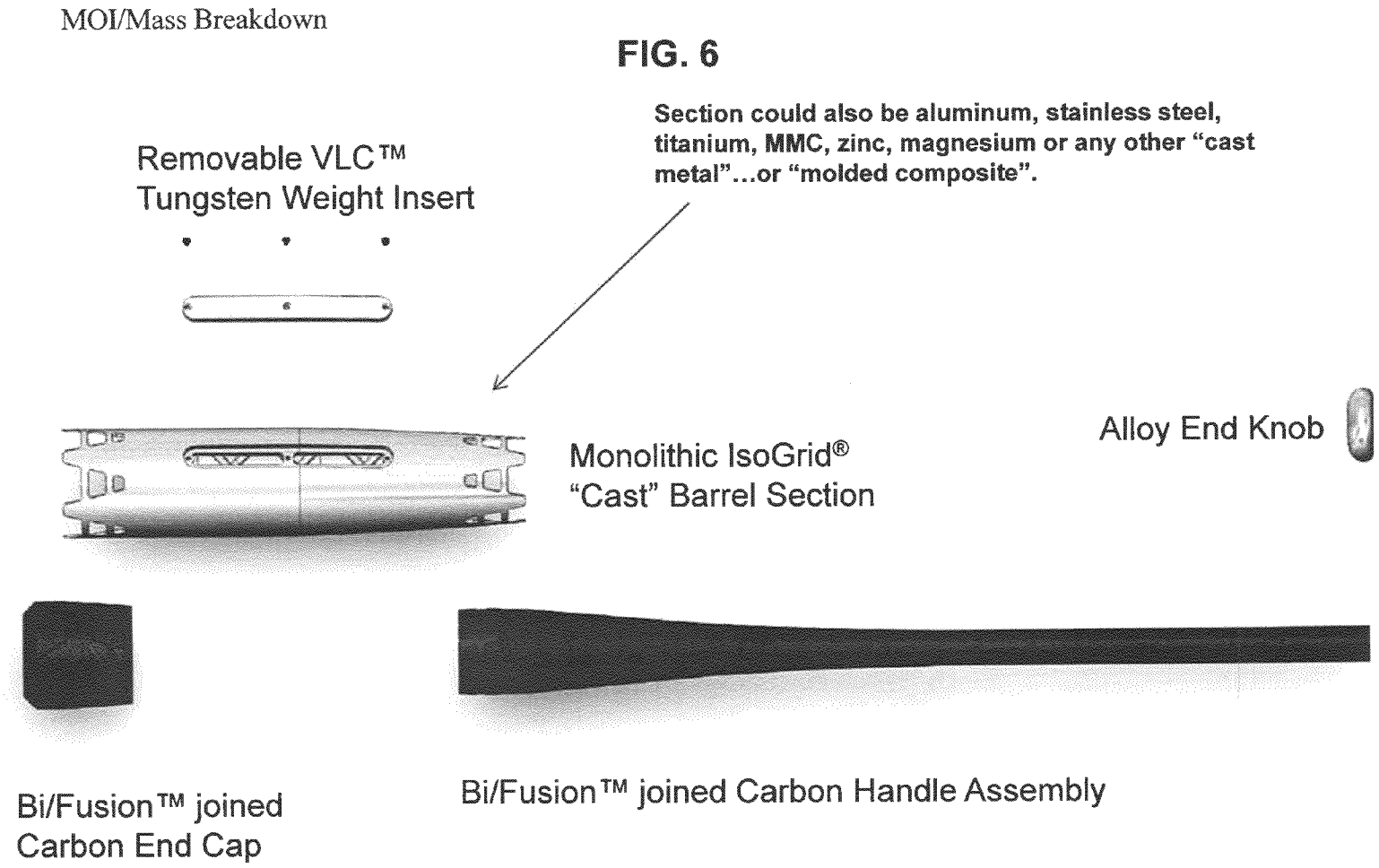

Titanium may also now be a viable material as it can be "cast" more cost-effectively and it's use can be restricted to the critical impact zone when used in conjunction with carbon handles and/or end caps (see FIG. 6).

It's even conceivable that some injection mold grade plastics would fit this requirement, especially for children's bats. Materials like Torion™ have very good properties and could be made inexpensively.

Figure 12:
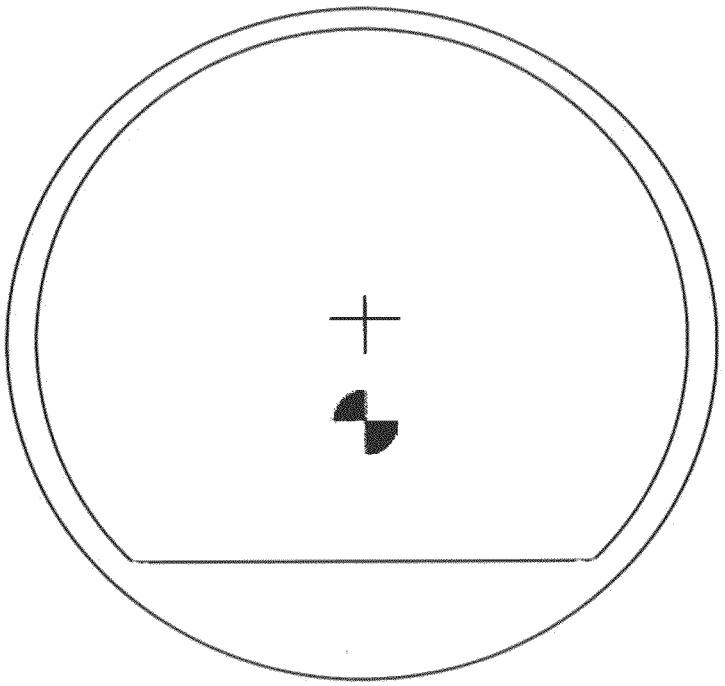
Figure 13:
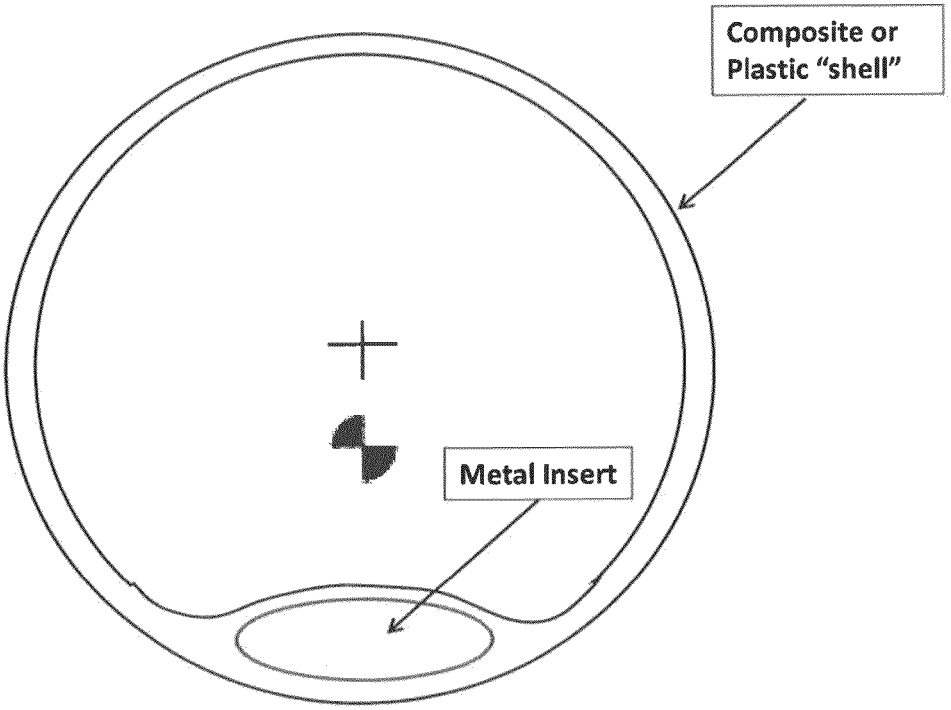

Future designs could be cast to vary (e.g., FIGS. 12 and 13) the wall thickness (and thus mass distribution) in a radial or circumferential direction as well, delivering the same "asymmetric CG location" but without the complexity (or cost) of removable weights.

In various embodiments, the present invention can also include the following benefits which are intended as only an example(s) of how this invention could evolve in the future:

Better Bat to Ball CG alignment in Neutral position—More Efficient Impact.

Pitcher or Situation specific orientation—Ground ball or Fly ball "choice."

Batter selected spin orientation—back spin or top spin.

Infinite number of combinations depending on variable mass & orientation.

Pitcher or Situation specific MOI adjustment by changing insert weight.

The VLC™ insert can also be positioned in front for "dead bat" bunting option.

VLC™ can adapt to lower price point bats w/internal mass positioning & materials.

These elements whether used independently or in combination(s), are the basis for this new invention.

A detailed embodiment and various properties are shown in the Figures, including FIGS. 6-13. This includes both a cast (Mg in this case) barrel region but also the adjoining carbon handle and carbon end cap.

The carbon handles function to provide desired stiffness at lower weight, excellent damping and compliance with the new BBCOR specifications. The carbon end cap shown here helps lower the overall MOI value as weight positioned at the end of the bat is the most critical and helps create a "tamper proof" bat for compliance with the ABI standards.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

Likewise, numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the disclosure, to the full extent indicated by the broad, general meaning of the terms in which the appended claims are expressed. To the extent that these various modifications do not depart from the spirit and scope of the appended claims, they are intended to be encompassed therein.

We claim:

1. A bat comprising:

a hollow monolithic cast metal barrel region having a wall with receiving apertures at a cap end and a handle end, the wall further having an insert receiving aperture;

a carbon handle directly affixed to said monolithic cast metal barrel region by a portion of said carbon handle extending through said receiving apertures proximate said handle end;

a carbon end cap directly affixed to said monolithic cast metal barrel region by extending through said receiving apertures proximate said cap end;

a weight insert affixed to said insert receiving aperture that creates an asymmetric center of gravity (CG) position in a barrel impact region; and a plurality of criss-crossing raised rib structures formed on an inner surface of the monolithic cast metal barrel region.

2. The bat of claim 1, wherein the monolithic cast metal barrel region has one of a uniform or non-uniform thickness.

3. The bat of claim 1, wherein the monolithic cast metal barrel region is magnesium.

4. The bat of claim 1 wherein the weight insert is removable.

5. The bat of claim 1 further comprising a weight insert that is adjustable.

* * * * *